US008245858B2

(12) United States Patent
Doran

(10) Patent No.: US 8,245,858 B2
(45) Date of Patent: Aug. 21, 2012

(54) SPORTS EQUIPMENT AND ACCESSORY HOLDING DEVICE

(76) Inventor: John Doran, Cypress, CA (US)

( * ) Notice: Subject to any disclaimer, the term of this patent is extended or adjusted under 35 U.S.C. 154(b) by 222 days.

(21) Appl. No.: 12/780,885

(22) Filed: May 15, 2010

(65) Prior Publication Data

US 2012/0187061 A1 Jul. 26, 2012

(51) Int. Cl.
*A47F 7/00* (2006.01)
*A47F 5/08* (2006.01)

(52) U.S. Cl. ..... 211/85.7; 211/87.01; 248/304; 248/316.1

(58) Field of Classification Search ..... 211/66, 211/70.2, 70.5, 70.6, 70.7, 70.8, 85.7, 87.01, 211/88.01, 113; 248/214, 215, 304, 314, 248/315, 316.1; D6/552
See application file for complete search history.

(56) References Cited

U.S. PATENT DOCUMENTS

| | | | | | |
|---|---|---|---|---|---|
| 3,178,141 | A | * | 4/1965 | Bloom | 248/113 |
| 3,650,407 | A | * | 3/1972 | Benham, Jr. | 211/14 |
| 3,653,624 | A | * | 4/1972 | Abel | 248/312 |
| 3,698,563 | A | * | 10/1972 | Gordon et al. | 211/85.7 |
| 4,583,647 | A | * | 4/1986 | Schinzing | 211/60.1 |
| 4,629,065 | A | * | 12/1986 | Braaten | 206/315.1 |
| D306,385 | S | * | 3/1990 | Alexander et al. | D6/552 |
| D309,226 | S | * | 7/1990 | Wilcox | D6/552 |
| D314,302 | S | * | 2/1991 | Snow | D6/552 |
| D356,002 | S | * | 3/1995 | Morgan | D6/552 |
| 5,413,228 | A | * | 5/1995 | Le Clerc | 211/13.1 |
| 5,462,328 | A | * | 10/1995 | Chandler et al. | 294/143 |
| D373,498 | S | * | 9/1996 | Young | D6/552 |
| 5,626,244 | A | * | 5/1997 | Mesna et al. | 211/60.1 |
| D404,952 | S | * | 2/1999 | Bauer | D6/552 |
| D417,113 | S | * | 11/1999 | Greaney et al. | D6/552 |
| D417,807 | S | * | 12/1999 | McBarnette | D6/513 |
| 6,053,340 | A | * | 4/2000 | Cameron | 211/85.7 |
| D431,137 | S | * | 9/2000 | McBarnette | D6/513 |
| D451,254 | S | * | 11/2001 | Egan | D32/73 |
| D460,652 | S | * | 7/2002 | Mahoney | D6/552 |
| D479,423 | S | * | 9/2003 | Mahoney | D6/552 |
| 6,695,155 | B1 | * | 2/2004 | Sofy et al. | 211/87.01 |
| 6,749,074 | B1 | * | 6/2004 | Hileman et al. | 211/85.7 |
| D493,056 | S | * | 7/2004 | Shornak | D6/552 |
| 6,905,036 | B2 | * | 6/2005 | Sofy et al. | 211/87.01 |
| D560,088 | S | * | 1/2008 | Tracy | D6/552 |
| D567,560 | S | * | 4/2008 | Byers | D6/553 |
| 7,434,699 | B2 | * | 10/2008 | Stukenberg | 211/41.1 |
| 7,673,759 | B2 | * | 3/2010 | Stukenberg | 211/41.7 |
| 7,784,624 | B1 | * | 8/2010 | Pinto | 211/85.7 |
| 7,789,248 | B1 | * | 9/2010 | Salerno et al. | 211/85.7 |
| 2007/0210228 | A1 | * | 9/2007 | Brenner et al. | 248/311.2 |
| 2011/0174945 | A1 | * | 7/2011 | Wood | 248/225.11 |

* cited by examiner

*Primary Examiner* — Darnell Jayne
*Assistant Examiner* — Joshua Rodden

(57) ABSTRACT

A sports equipment accessory holding device featuring a generally pentagonal-shaped base; an extension platform extending outwardly from the front surface of the base; hooks extending forwardly from each the first and second side edges of the base; a two-prong bracket extending outwardly from the bottom edge of the base, wherein the extension platform, the hooks, and the two-prong bracket each function to hold an object; a first mounting component extending outwardly from the back surface of the base; and a second mounting component disposed on the back surface of the base below the first mounting component, wherein the first mounting component and second mounting component together function to engage a fence for mounting the holding device.

19 Claims, 8 Drawing Sheets

SPORTS EQUIPMENT AND ACCESSORY HOLDING DEVICE

FIELD OF THE INVENTION

The present invention is directed to a holding device for softball and baseball equipment and accessories, more particularly to a holding device mountable in dugout fences.

BACKGROUND OF THE INVENTION

Most sports require players to have many different pieces of equipment in addition to other accessories. For example, in baseball, softball, and the like, players generally have a bat, a helmet, and a glove. Most players also have items such as water bottles and towels with them during the sporting event or practice. In confined spaces such as dugouts, equipment and accessories can easily become disorganized. The disorganized items can be a safety hazard and can become damaged, particularly because of the tendency of players to run in and out of the dugout. Many water bottles or sports drink bottles end up being thrown away because players lose track of whose bottle is whose.

The present invention features a holding device for organizing and holding sports equipment and accessories. The device of the present invention can be easily hung in various places, for example in the fence of a dugout. The device keeps each player's items in a specific location, preventing the items from becoming a safety hazard or from becoming damaged.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
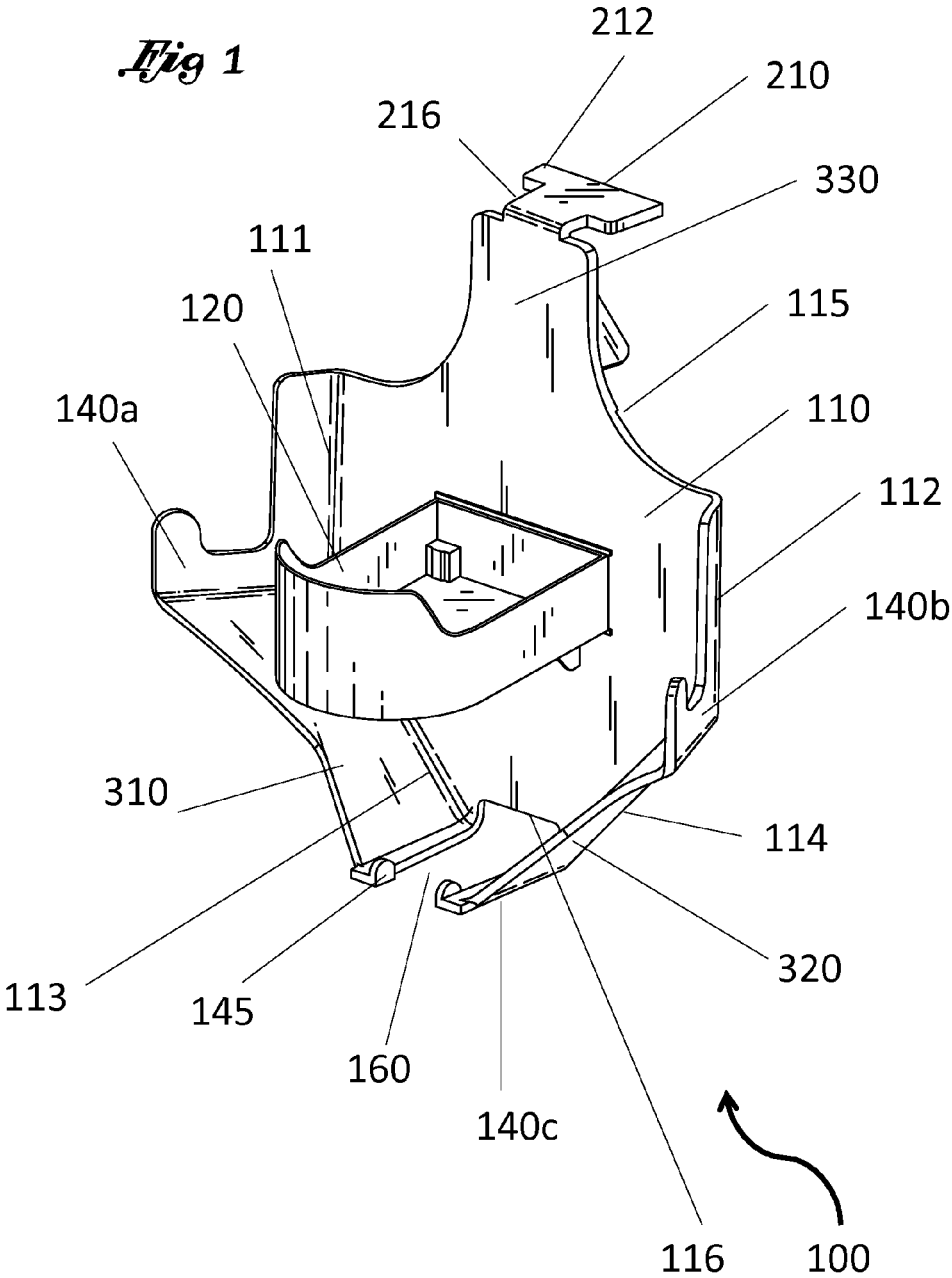
FIG. 1 is a front perspective view of the holding device of the present invention.
Figure 2:
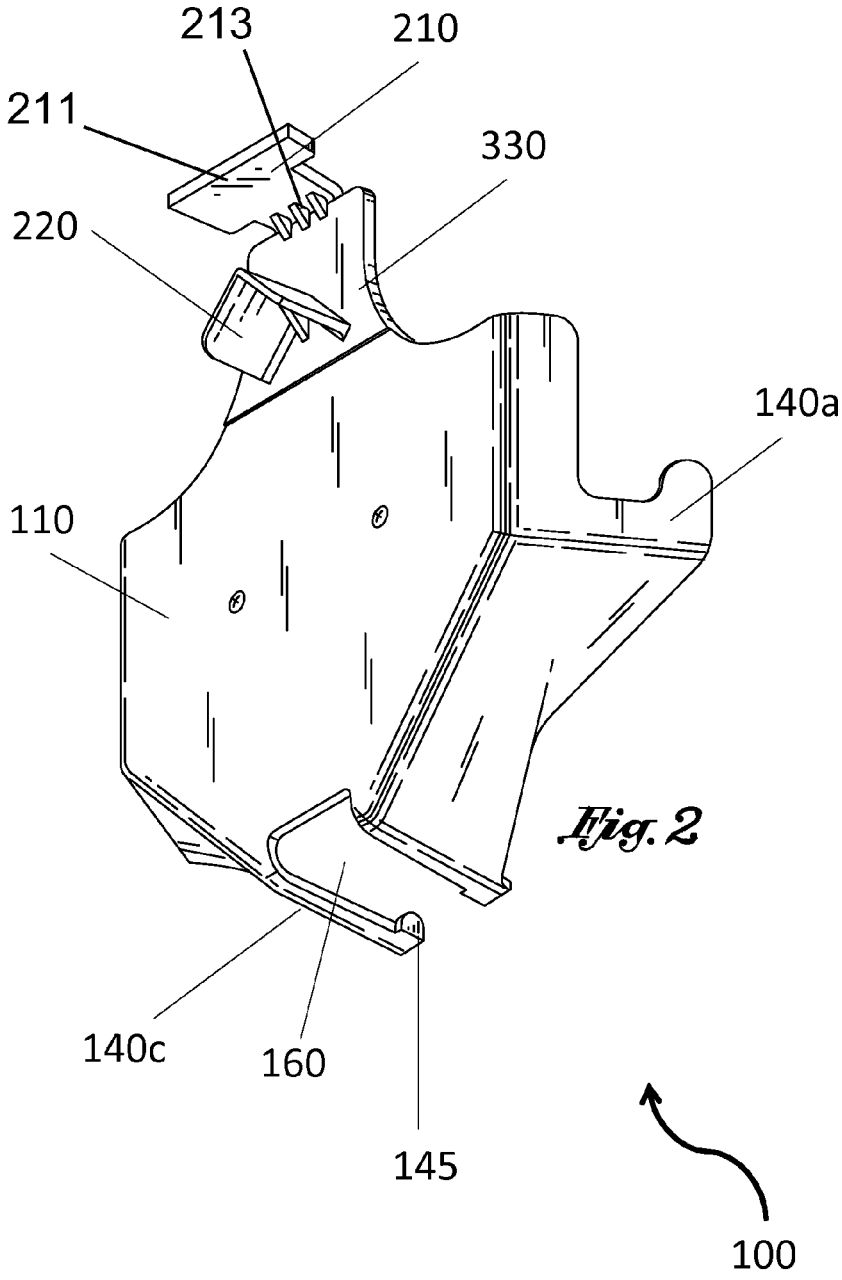
FIG. 2 is a rear perspective view of the holding device of FIG. 1.
Figure 3:
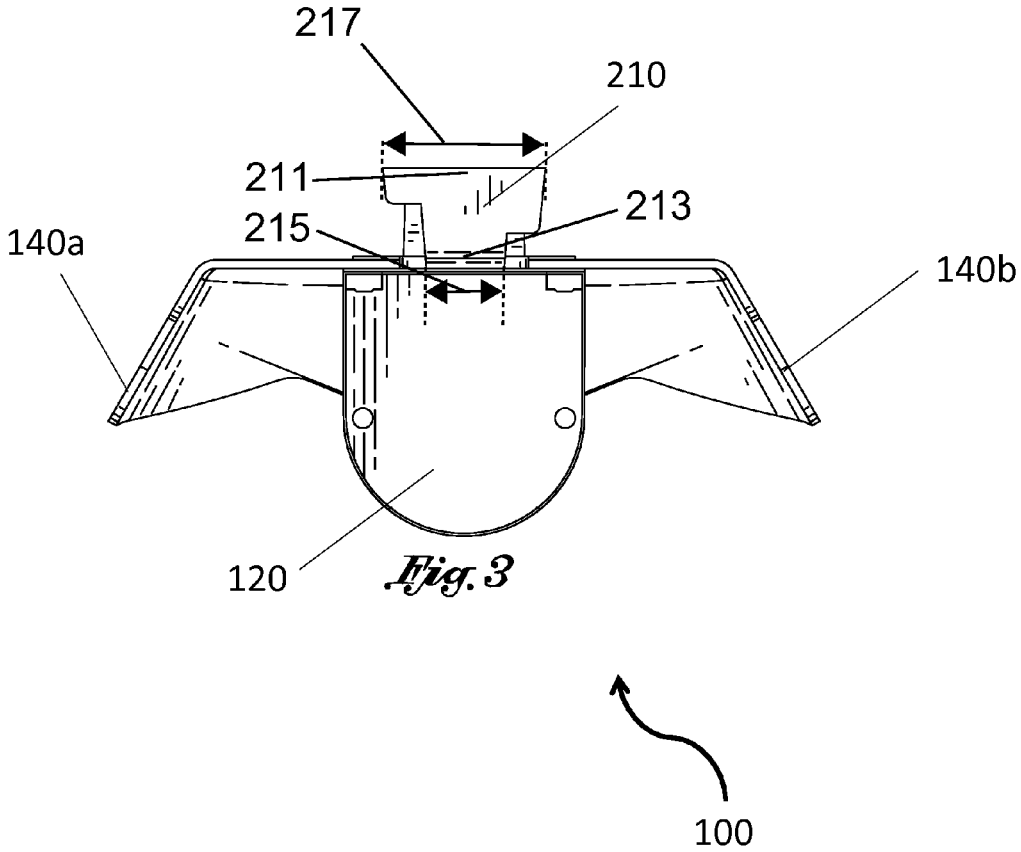
FIG. 3 is a top view of the holding device of FIG. 1.
Figure 4:
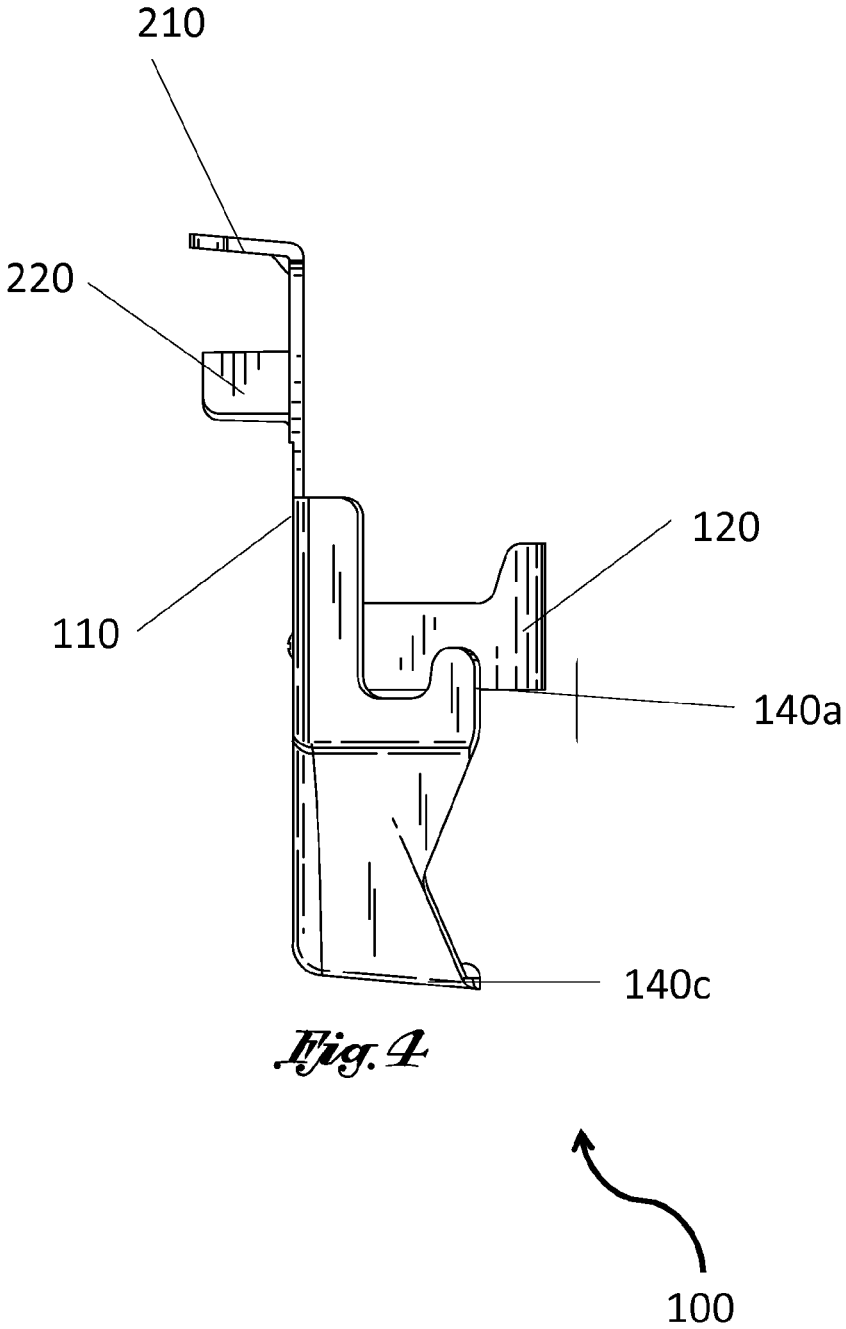
FIG. 4 is a first side view of the holding device of FIG. 1.
Figure 5:
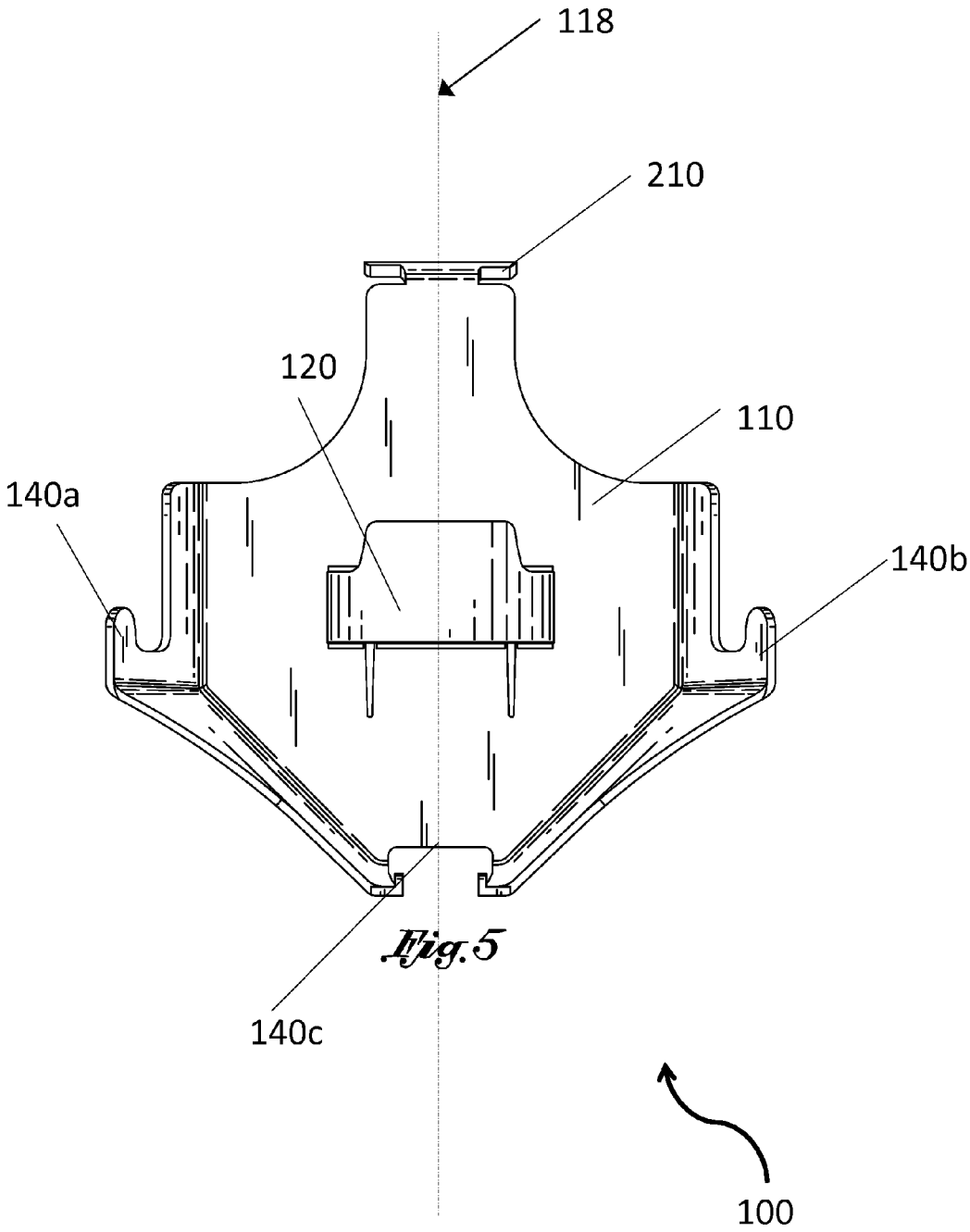
FIG. 5 is a front view of the holding device of FIG. 1.
Figure 6:
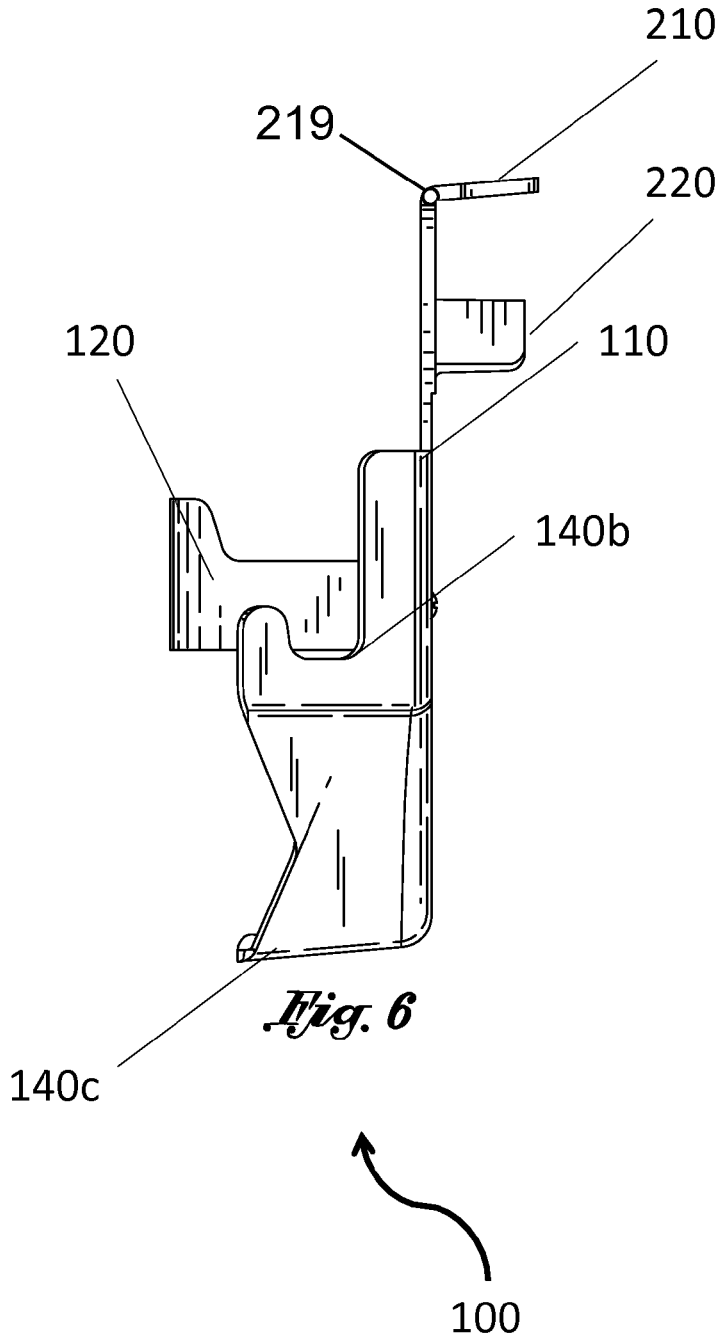
FIG. 6 is a second side view of the holding device of FIG. 1.
Figure 7:
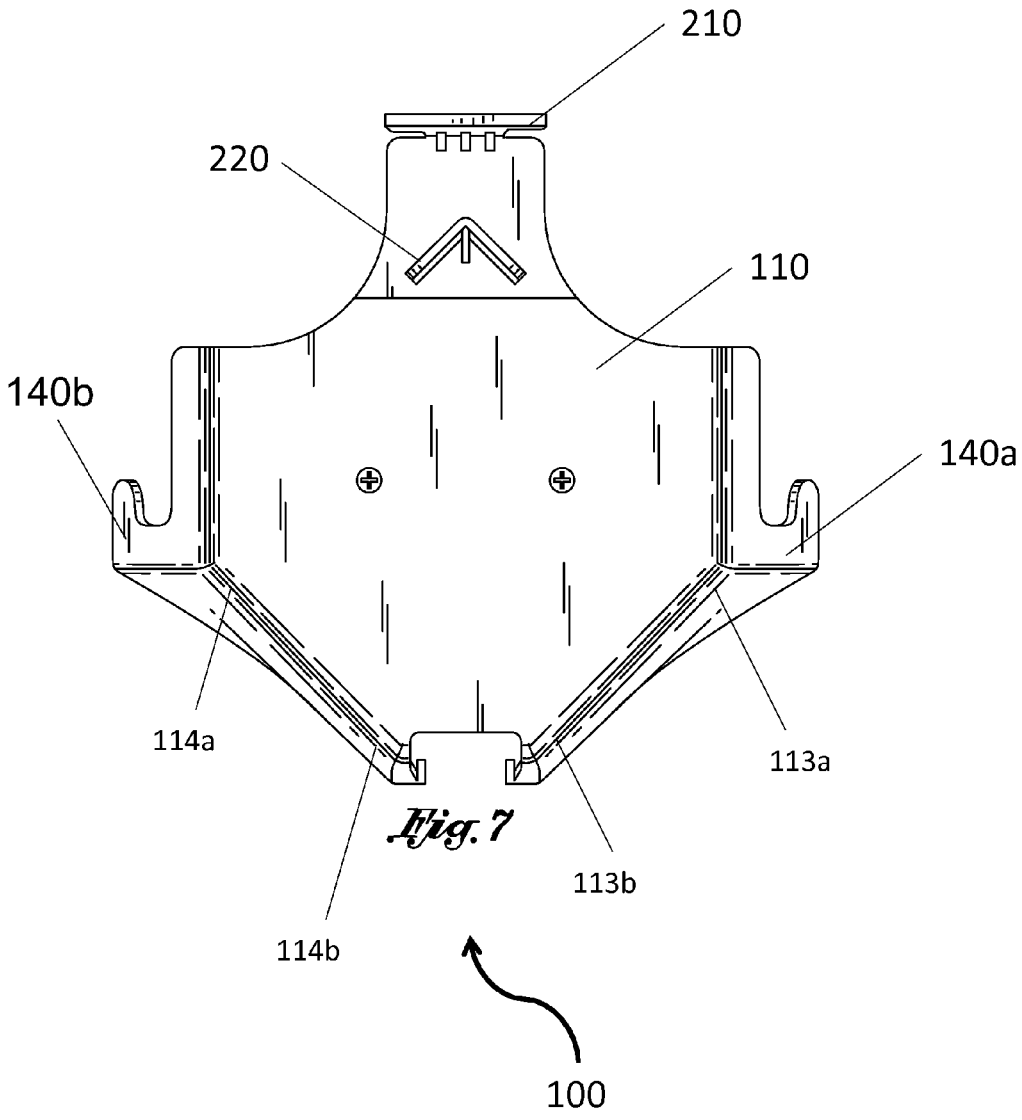
FIG. 7 is a rear view of the holding device of FIG. 1.
Figure 8:
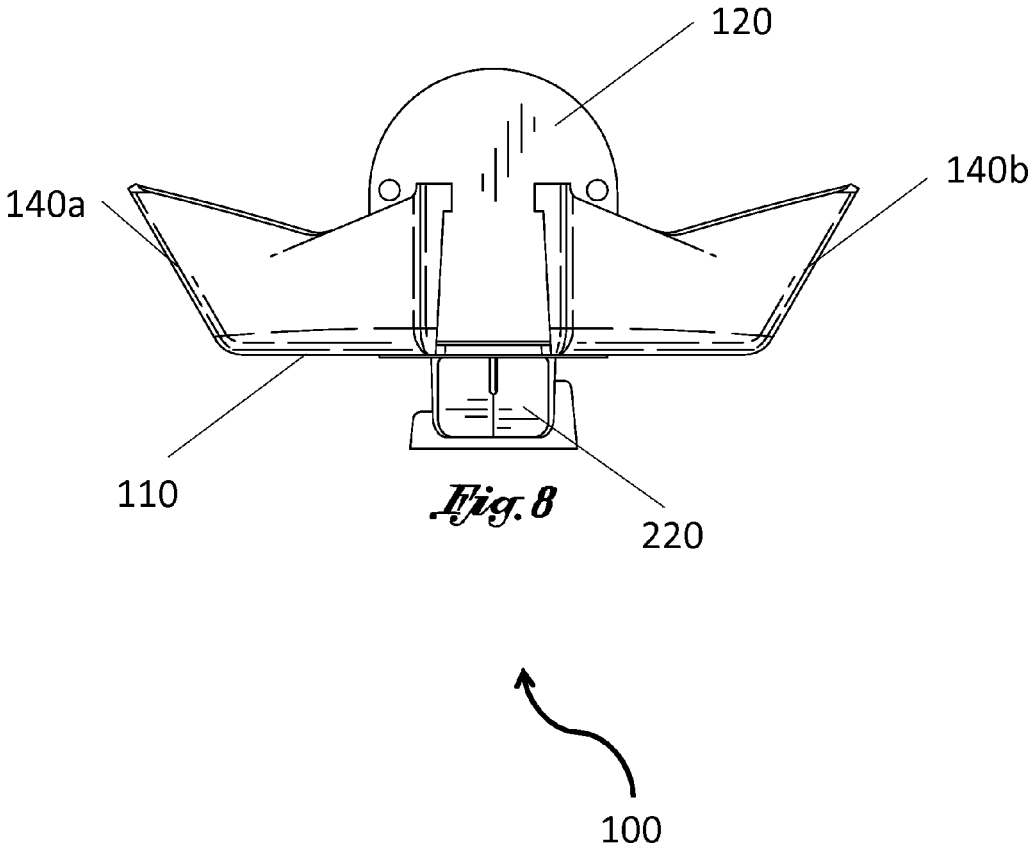
FIG. 8 is a bottom view of the holding device of FIG. 1.

Referring now to FIGS. 1-8, the present invention features a sports equipment and accessory holding device 100 for organizing and holding sports equipment and accessories including but not limited to a bottle, a bat, a helmet, a cap, a glove, a mitt, a visor, a towel, an item of clothing, the like, or a combination thereof. The accessory holding device 100 of the present invention can be easily hung in various places, for example in the fence of a dugout. The accessory holding device 100 keeps each player's items in a specific location, preventing the items from becoming a safety hazard or from becoming damaged. In some embodiments, a sports equipment and accessory holding device (100) comprises a base (110) having a front surface, a back surface, a first side edge (111), a second side edge (112), a third side edge (113), a fourth side edge (114), a top edge (115), and a bottom edge (116). In some embodiments, a lower portion (113*b*) of the third side edge (113) is closer to a middle (118) of the base (110) as compared to an upper portion (113*a*) of the third side edge (113). In some embodiments, a lower portion (114*b*) of the fourth side edge (114) is closer to the middle (118) of the base (110) as compared to an upper portion (114*a*) of the fourth side edge (114). In some embodiments, the device (100) comprises an extension platform (120) extending outwardly from the front surface of the base (110). In some embodiments, the extension platform (120) comprises a raised side edge for helping to enclose a first object placed on the extension platform (120). In some embodiments, the device (100) comprises a first hook (140*a*) extending forwardly from the front surface of the base (110) from the first side edge of the base (110). In some embodiments, the first hook (140*a*) functions to hold a second object. In some embodiments, the device (100) comprises a second hook (140*b*) extending forwardly from the front surface of the base (110) from the second side edge of the base (110). In some embodiments, the second hook (140*b*) functions to hold a third object. In some embodiments, the device (100) comprises a two-prong bracket (140*c*) extending outwardly from the bottom edge (116) of the base (110). In some embodiments, the two-prong bracket (140*c*) functions to hold a fourth object. In some embodiments, a slot (160) is located in between the two-prong bracket (140*c*). In some embodiments, the device (100) comprises a first mounting component (210) extending outwardly away from the back surface of the base (110). In some embodiments, the first mounting component (210) is generally flat. In some embodiments, at least one wing (212) is located on a side edge of the first mounting component (210) to form a groove (216) at a point where the first mounting component (210) and the back surface of the base (110) connect. In some embodiments, a distal end (211) of the first mounting component (210) and the wing (212) comprise a combined width (217) larger than the width (215) of the proximal end (213) of the first mounting component (210). In some embodiments, the proximal end (213) of the first mounting component (210) is located on the back surface of the base (110). In some embodiments, the width (215) of the proximal end (213) of the first mounting component (210) flares to a larger combined width (217) of the first mounting component (210) and the wing (212) on the distal end (211) of the mounting component (210). In some embodiments, the device (100) comprises a second mounting component (220) located on the back surface of the base (110) below the first mounting component (210). In some embodiments, the second mounting component (220) is a protrusion. In some embodiments, the second mounting component (220) has a generally V-shape. In some embodiments, a vertex of the second mounting component (220) faces the first mounting component (210). In some embodiments, the first mounting component (210) and second mounting component (220) together function to engage a fence for mounting the holding device (100).

The accessory holding device 100 of the present invention comprises a base 110 having a front surface, a back surface, a first side edge (11, a second side edge 112, a third side edge 113, a fourth side edge 114, a top edge 115, and a bottom edge 116. Generally, the lower portion 113*b* of the third side edge 113 is closer to the middle 118 of the base 110 as compared to the upper portion 113*a* of the third side edge 113, and the lower portion 114*b* of the fourth side edge 114 is closer to the middle 118 of the base 110 as compared to the upper portion 114*a* of the fourth side edge 114.

The device 100 of the present invention further comprises an extension platform 120 extending outwardly from the front surface of the base 110. As shown in FIG. 1, the extension platform 120 may extend from a middle area of the base 110, however the present invention is not limited to this configuration. The extension platform 120 comprises a raised side edge for helping to enclose a first object placed on the extension platform 120 (e.g., a bottle, a cup, etc.). The extension platform 120 may be of various shapes and sizes (e.g., heights, lengths, etc.). In some embodiments, the base 110 has a cut out positioned at where the extension platform 120 is located. For example, the cut out is positioned in a way that a first object disposed on the extension platform may be visually detected when looking through the cut out from the back of the base 110.

A first hook 140*a* extends from the first side edge (11 of the base 110 forwardly from the front surface of the base 110, and a second hook 140*b* extends from the second side edge 112 of the base 110 forwardly from the front surface of the base 110. The first hook 140*a* and second hook 140*b* each function to hold a second object and third object, respectively (e.g., a helmet, a hat, etc.). The first hook 140*a* extends outwardly from the first side edge of the base 110 at a first angle, and the second hook 140*b* extends outwardly from the first side edge of the base 110 at a second angle. The angles of the hooks 140*a*, 140*b* may help to provide more room for hanging objects (e.g., helmets, caps, etc.), for example the hooks 140*a*, 140*b* may help position such items away from the extension platform 120 to prevent crowding.

In some embodiments, the first angle is about 45 degrees with respect to the front surface of the base 110. In some embodiments, the first angle is between about 10 to 50 degrees with respect to the front surface of the base 110. In some embodiments, the first angle is between about 50 to 90 degrees with respect to the front surface of the base 110. In some embodiments, the second angle is about 45 degrees with respect to the front surface of the base 110. In some embodiments, the second angle is between about 10 to 50 degrees with respect to the front surface of the base 110. In some embodiments, the second angle is between about 50 to 90 degrees with respect to the front surface of the base 110.

A two-prong bracket 140*c* extends outwardly from the bottom edge 116 of the base 110. The two-prong bracket 140*c* functions to hold a fourth object (e.g., a bat). A slot 160 is disposed in between the two-prong bracket 140*c*. The slot 160 may be of various sizes and shapes to accommodate various objects. The two-prong bracket 140*c* may further comprises opening tips 145 disposed on outer edges of the slot 160 which are tilted upwardly. The opening tips 145 may function to help prevent the fourth object from sliding off of the two-prong bracket 140*c*.

The base 110 can be mounted on various objects including but not limited to a fence (e.g., a fence at a dugout, etc.), for example via mounting components 210, 220. A first mounting component 210 extends outwardly away from the back surface of the base 110. In some embodiments, the first mounting component 210 is generally flat. In some embodiments, the first mounting component 210 is positioned generally perpendicularly to the base 110. In some embodiments, the first mounting component 210 is pivotally attached to the base 110 (e.g., via a pivot component). In some embodiments, the first mounting component pivotally attaches to the base (110) via a pivot component (219). At least one wing 212 is disposed on a side edge of the first mounting component 210 to form a groove 216 at a point where the first mounting component 210 and the back surface of the base 110 connect. The wing(s) 212 may help to secure the first mounting component 210 in an object such as a fence. A second mounting component 220 (e.g., a protrusion) is disposed on the back surface of the base 110 below the first mounting component 210. The second mounting component 220 may be constructed in a variety of shapes and sizes. In some embodiments, the second mounting component 220 is generally V-shaped, however the second mounting component 220 is not limited to this shape. The second mounting component 220 may comprise a vertex, wherein the vertex faces the first mounting component 210. The first mounting component 210 and the second mounting component 220 together function to engage the object (e.g., a fence) for mounting the holding device 100.

In some embodiments, the device 100 of the present invention further comprises an extension 330 extending upwardly from the top edge 115 of the base 110. In some embodiments, the first mounting component 210 and second mounting component 220 are each mounted on a back of the extension 330 instead of the back surface of the base 110.

In some embodiments, the first mounting component 210 and vertex of the second mounting component 220 are between about 0.5 to 1.0 inches apart. In some embodiments, the first mounting component 210 and vertex of the second mounting component 220 are between about 1 to 2 inches apart. In some embodiments, the first mounting component 210 and vertex of the second mounting component 220 are between about 2 to 3 inches apart.

The device 100 of the present invention may be constructed in a variety of shapes and sizes. For example, in some embodiments, the base 110 has a general shape of a pentagon, wherein a vertex of the pentagon corresponds with the slot 160 formed by the two-prong bracket 140*c* and a top side of the pentagon corresponds with the top edge 115 of the base 110. In some embodiments, the extension platform 120 is between about 1 to 2 inches in length (e.g., from the base 110 to an outer edge of the extension platform 120). In some embodiments, the extension platform 120 is between about 2 to 4 inches in length, e.g., about 3 inches (e.g., from the base 110 to an outer edge of the extension platform 120).

As used herein, the term "about" refers to plus or minus 10% of the referenced number. For example, an embodiment wherein the extension platform 120 is about 4 inches in length includes an extension platform 120 that is between 3.6 and 4.4 inches in length.

In some embodiments, the device 100 of the present invention further comprises a first connecting plate 310 extending forwardly from the front surface of the base 110, wherein the first connecting plate 310 connects the first hook 140*a* and the two-prong bracket. In some embodiments, the device 100 of the present invention further comprises a second connecting plate 320 extends forwardly from the front surface of the base 110, wherein the second connecting plate 320 connects the second hook 140*b* and the two-prong bracket.

The first object, the second object, the third object, or the fourth object included but is not limited to a bottle, a bat, a helmet, a cap, a glove, a mitt, a visor, a towel, an item of clothing, or a combination thereof.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sports equipment and accessory holding device (100) comprising:

(a) a base (110) having a front surface, a back surface, a first side edge (111), a second side edge (112), a third side edge (113), a fourth side edge (114), a top edge (115), and a bottom edge (116), wherein a lower portion (113*b*) of the third side edge (113) is closer to a middle (118) of the base (110) as compared to an upper portion (113*a*) of the third side edge (113), wherein a lower portion (114*b*) of the fourth side edge (114) is closer to the middle (118) of the base (110) as compared to an upper portion (114*a*) of the fourth side edge (114);

(b) an extension platform (120) extending outwardly from the front surface of the base (110), the extension platform (120) comprises a raised side edge for helping to enclose a first object placed on the extension platform (120);

(c) a first hook (140*a*) extending forwardly from the front surface of the base (110) from the first side edge of the base (110), the first hook (140*a*) functions to hold a second object;

(d) a second hook (140*b*) extending forwardly from the front surface of the base (110) from the second side edge of the base (110), the second hook (140*b*) functions to hold a third object;

(e) a two-prong bracket (140*c*) extending outwardly from the bottom edge (116) of the base (110), the two-prong bracket (140*c*) functions to hold a fourth object, wherein a slot (160) is disposed in between the two-prong bracket (140*c*), (f) a first mounting component (210) extending outwardly away from the back surface of the base (110), the first mounting component (210) being generally flat, wherein at least one wing (212) is disposed on a side edge of the first mounting component (210) to form a groove (216) at a point where the first mounting component (210) and the back surface of the base (110) connect, wherein a distal end (211) of the first mounting component (210) and the wing (212) comprises a combined width (217) larger than the width (215) of the proximal end (213) of the first mounting component (210), wherein the proximal end (213) of the first mounting component (210) is disposed on the back surface of the base (110), and wherein the width (215) of the proximal end (213) of the first mounting component (210) flares to the larger combined width (217) of the first mounting component (210) and the wing (212) on the distal end (211) of the mounting component (210); and (g) a second mounting component (220) disposed on the back surface of the base (110) below the first mounting component (210), the second mounting component (220) is a protrusion, wherein the second mounting component (220) has a generally V-shape, wherein a vertex of the second mounting component (220) faces the first mounting component (210), wherein the first mounting component (210) and second mounting component (220) together function to engage a fence for mounting the holding device (100).

2. The holding device of claim 1, wherein the base (110) has a general shape of a pentagon, wherein a vertex of the pentagon corresponds with the slot (160) formed by the two-prong bracket (140*c*), and a top side of the pentagon corresponds with the top edge (115) of the base (110).

3. The holding device of claim 1, wherein the base (110) has a general shape of a pentagon, wherein a vertex of the pentagon corresponds with the slot (160) formed by the two-prong bracket (140*c*), and a top side of the pentagon corresponds with the top edge (115) of the base (110), wherein the top edge (115) of the base (110) comprises an extension extending upwardly from the top edge (115) of the base (110), the first mounting component (210) and second mounting component (220) are each mounted on a back of the extension.

4. The holding device of claim 1, wherein the extension platform (120) is between about 1 to 4 inches in length.

5. The holding device of claim 1, wherein the extension platform (120) is about 3 inches in length.

6. The holding device of claim 1, wherein the first hook (140*a*) extends outwardly from the first side edge of the base (110) at a first angle.

7. The holding device of claim 6, wherein the first angle is about 45 degrees with respect to the front surface of the base (110).

8. The holding device of claim 6, wherein the first angle is between about 10 to 50 degrees with respect to the front surface of the base (110).

9. The holding device of claim 6, wherein the first angle is between about 50 to 90 degrees with respect to the front surface of the base (110).

10. The holding device of claim 1, wherein the second hook (140*b*) extends outwardly from the second side edge of the base (110) at a second angle.

11. The holding device of claim 10, wherein the second angle is about 45 degrees with respect to the front surface of the base (110).

12. The holding device of claim 10, wherein the second angle is between about 10 to 50 degrees with respect to the front surface of the base (110).

13. The holding device of claim 10, wherein the second angle is between about 50 to 90 degrees with respect to the front surface of the base (110).

14. The holding device of claim 1, wherein the first mounting component (210) is generally flat and is positioned generally perpendicularly to the base (110).

15. The holding device of claim 1, wherein the first mounting component is pivotally attached to the base (110) via a pivot component (219).

16. The holding device of claim 1, wherein the first mounting component (210) and the vertex of the second mounting component (220) are between about 0.5 to 3 inches apart.

17. The holding device of claim 1 further comprising a first connecting plate (310) extending forwardly from the front surface of the base (110), the first connecting plate (310) connects the first hook (140*a*) and the two-prong bracket.

18. The holding device of claim 1 further comprising a second connecting plate (320) extending forwardly from the front surface of the base (110), the second connecting plate (320) connects the second hook (140*b*) and the two-prong bracket.

19. The holding device of claim 1 further comprising opening tips (145) disposed on outer edges of the slot (160) which are tilted upwardly, the opening tips (145) function to help prevent the fourth object from sliding off of the two-prong bracket (140*c*).

* * * * *